US008906174B2

(12) United States Patent
Imano et al.

(10) Patent No.: US 8,906,174 B2
(45) Date of Patent: Dec. 9, 2014

(54) NI-BASE ALLOY AND METHOD OF PRODUCING THE SAME

(75) Inventors: Shinya Imano, Hitachi (JP); Jun Sato, Hitachi (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 858 days.

(21) Appl. No.: 12/707,748

(22) Filed: Feb. 18, 2010

(65) Prior Publication Data

US 2010/0243111 A1 Sep. 30, 2010

(30) Foreign Application Priority Data

Mar. 31, 2009 (JP) ..... 2009-083990

(51) Int. Cl.

| | |
|---|---|
| ***C22F 1/10*** | (2006.01) |
| ***C22F 1/16*** | (2006.01) |
| ***C22C 19/05*** | (2006.01) |
| ***C22C 30/00*** | (2006.01) |

(52) U.S. Cl.
USPC ..... 148/675; 148/707; 148/410; 148/419

(58) Field of Classification Search
CPC ..... C22F 1/10; C22C 19/055; C22C 19/056; C22C 19/057; C22C 30/00
USPC ..... 148/675, 707, 410, 419
See application file for complete search history.

(56) References Cited

U.S. PATENT DOCUMENTS

| | | | | |
|---|---|---|---|---|
| 4,798,632 | A * | 1/1989 | Yonezawa et al. | 148/675 |
| 5,527,403 | A * | 6/1996 | Schirra et al. | 148/675 |
| 2005/0072500 | A1 | 4/2005 | Cao et al. | |

FOREIGN PATENT DOCUMENTS

| | | | |
|---|---|---|---|
| EP | 1 096 033 | A1 | 5/2001 |
| EP | 1 591 548 | A1 | 11/2005 |
| EP | 1 605 074 | A1 | 12/2005 |
| GB | 2 098 119 | A | 11/1982 |
| GB | 2 307 483 | A | 5/1997 |
| JP | 58-113361 | A | 7/1983 |

OTHER PUBLICATIONS

F. Schubert et al., Wrought Ni-Base Alloys for Rotor Shafts in Advanced USC Power Plants, Proceedings from the Fourth International Conference on Advances in Materials Technology for Fossil Power Plants, Oct. 25-28, 2004, pp. 587-601.

Affection of precipitation on a η phase on high temperature strength of a Ni-base superalloy of Ni-20Cr-20Co-0.5AI-2.2Ti-6Mo, Heat-resistant Metal Material 123 Committee, Unit Session of Superalloy, Research Report of vol. 49, No. 1, 2008.

* cited by examiner

*Primary Examiner* — Jessee Roe
(74) *Attorney, Agent, or Firm* — Mattingly & Malur, PC

(57) ABSTRACT

Disclosed are a high-strength Ni-base alloy, a method of producing the Ni-base alloy, and a method of recovering a member made of a degraded Ni-base alloy. It contains not more than 0.1 wt % C, not more than 50 wt % Fe, not more than 30 wt % Cr, Ti, and at least one of Nb and Al. It has been strengthened by precipitates of a γ' phase ($Ni_3Al$) and/or a γ" phase ($Ni_3Nb$). It contains also a η phase ($Ni_3Ti$) which is thermodynamically stable in a temperature range of 800° C. to 900° C. When observed a cross-section of the Ni-base alloy, a plurality of nodes exist along each segment connecting two meeting points each of which point is defined by adjacent three crystal grains, and precipitates of the γ' phase and/or the γ" phase in each of crystal grains of the Ni-base alloy have an average particle size of not more than 100 nm.

8 Claims, 3 Drawing Sheets

1a

NI-BASE ALLOY AND METHOD OF PRODUCING THE SAME

CROSS-REFERENCE TO RELATED APPLICATION (The present application claims priority from JP patent application Ser. No. 2009-083990 filed on Mar. 31, 2009, the content of which is hereby incorporated by reference into this application.)

BACKGROUND OF THE INVENTION

1. Field of the Invention

The present invention relates to high-temperature components of gas turbines, steam turbines and the like, to a Ni-base alloy used in such high-temperature components, and to a method of producing the Ni-base alloy.

2. Description of Related Art

Many high-strength Ni-base alloys have been strengthened by precipitation of γ' phase ($Ni_3Al$) and/or γ" phase ($Ni_3Nb$) within each of crystal grains. In order to provide Ni-base forging alloy with high strength and high ductility properties, it is essential to strengthen crystal grains at those grain boundaries as well as internally. Hitherto for the purpose of restraining occurrence of sliding at grain boundaries of crystal grains and of growth of cracks along the grain boundaries, the grain boundaries have been strengthened by causing lumps of carbide of Mo, Ti, Ta and so on to precipitate at the grain boundaries. However, since those carbides serves as starting points of occurrence of cracks due to low cycle fatigue, recently high-strength Ni-base forging alloys have been provided on conditions of low carbon and restrained amount of carbide precipitates. In this case, since the grain boundaries are made smooth, once the cracks occur, those grow quickly to result in fracture.

In a Ni—Fe alloy (Ni-36Fe-16Cr-3Nb-1.7Ti-0.2Al-0.03C) used to make a gas turbine disk, the η phase, which has been known as a detrimental phase in a superalloy, precipitates in a temperature of 800° C. to 900° C. Thus, the Ni—Fe alloy is subjected to a solution heat treatment at a temperature of 982° C. at which the η phase does not precipitate, and subsequently subjected to aging treatment at a temperature of not higher than 750° C. thereby causing the γ' phase and the γ" phase to finely precipitate in each of crystal grains without precipitation of the γ phase. Although the thus obtained material exhibits high strength, it has a characteristic that a growth rate of cracks in a high temperature is high because of a low amount of additive carbon for the purpose of restraining occurrence of cracks thereby causing grain boundaries smooth.

There is shown an evaluation of strength of the above alloy in a literature of "Advances in Materials Technology for fossil Power Plants (Proceeding from the Fourth International Conference, 2004, 587.)", according to which the alloy has been subjected to an aging treatment at a temperature of 840° C. thereby causing the γ phase to precipitate, and subsequently subjected to an aging treatment at a temperature of not higher than 750° C. thereby causing the γ' phase and the γ" phase to finely precipitate. While in general, the η phase precipitates in a lamellar state from an initiation point at grain boundaries, the above literature teaches that the η phase makes the grain boundaries to have zigzag features thereby enabling the crack growth rate to be 1/100.

On the other hand, a literature of "Research Report from the Heat-Resistant Material 123 Committee, Vol. 49, No. 57" discloses that high-temperature ductility is improved, and acceleration of creep deformation is restrained by lamellar precipitation of the η phase at grain boundaries.

BRIEF SUMMARY OF THE INVENTION

As taught in the above literatures, it is possible to improve intra-grain strength by the lamellar precipitation of the η phase at the grain boundaries. However, this poses the following two problems. First, since the η phase contains Ti as a main component, which stabilizes the γ' and γ" phases, if a large quantity of the η phase precipitates, a precipitation quantity of γ' and γ" phases decreases thereby deteriorating intra-grain strength. Second, in order to make the η phase to quickly precipitate, a temperature of aging heat treatment must be higher than 800° C. However, in such a temperature range, the γ' and γ" phases are coarsened after precipitation thereof. With regard to the intra-grain strength, in the case of the identical quantity of precipitates, the finer the particle size is, the higher the strength becomes, and the larger the particle size is, the lower the strength becomes. In the case where the η phase is caused to precipitate in a temperature exceeding 800° C., while the strength at grain boundaries are improved, there arises a problem that intra-grain strength is deteriorated because precipitates in each of crystal grains decrease and become coarse.

Thus, an object of the present invention is to make the grain boundaries to have zigzag features by precipitation of the η phase, and simultaneously increase a quantity of fine precipitates in each of crystal grains thereby making intra-grain and inter-grains strengths compatible.

The present invention relates to a high-strength forging Ni-base alloy and a method of producing the forging Ni-base alloy, and in particular, to a Ni-base alloy in which grain boundaries are provided with zigzag features. More specifically, the invention Ni-base alloy comprises not more than 0.1 wt % C, not more than 50 wt % Fe, and not more than 30 wt % Cr, wherein the γ phase ($Ni_3Ti$) is thermodynamically stable in a temperature of 800° C. to 900° C., and wherein the Ni-base alloy is strengthened by precipitation of the γ' phase ($Ni_1Al$) and/or the γ" phase ($Ni_3Nb$). In the Ni-base alloy, the grain boundaries are provided with zigzag features, and the γ' phase and/or the γ" phase are finely precipitated in each of crystal grains.

Herein, the wording "the grain boundaries provided with zigzag features" are so defined that a plurality of nodes exist along each segment connecting two meeting points each of which point is defined by adjacent three crystal grains. Also herein, the wording "the γ' phase and/or the γ" phase finely precipitated in each of crystal grains" mean a state that precipitates of the γ' phase ($Ni_3Al$) and/or the γ' phase ($Ni_3Nb$) in each of crystal grains have an average particle size of not more than 100 nm. The Ni-base alloy having such characteristics has an excellent property of high-temperature strength.

According to a method of producing the Ni-base alloy of the present invention, the Ni-base alloy is subjected to a heat treatment which comprises the steps of:

subjecting the Ni-base alloy to a first solution heat treatment;

subjecting the Ni-base alloy, processed by the solution heat treatment, to a first aging treatment to precipitate a γ' phase and/or a γ" phase, and a γ phase thereby making grain boundaries of the Ni-base alloy irregular;

subjecting the Ni-base alloy, processed by the first aging treatment, to a second solution heat treatment to remove the γ' phase and/or the γ" phase, and the γ phase; and subjecting the Ni-base alloy, processed by the second solution heat treatment, to a second aging treatment to finely precipitate the γ' phase and/or the γ" phase in each crystal grain of the Ni-base alloy.

According to the heat treatment method, it is possible to strengthen the each crystal grain by fine precipitates while providing the grain boundaries with zigzag features thereby making the Ni-base alloy to have excellent properties of strength, ductility, and fatigue strength.

Specifically, the above heat treatment method is carried out, with use of the Ni-base alloy having the η phase ($Ni_3Ti$) thermodynamically stable in a temperature of 800° C. to 900° C., by conducting the first solution heat treatment, the first aging treatment, the second solution heat treatment, and the second aging treatment in this order.

The first solution heat treatment is conducted at a temperature not lower than solid solution temperatures of the γ', γ" and γ phases.

The first aging treatment is conducted at a temperature of 800° C. to 900° C.

And the second solution heat treatment is conducted at a temperature which is higher than the solid solution temperatures of the γ' and γ" phases, and higher than the solid solution temperature of the γ phase by 10° C.

It is possible to apply the invention method to a component made of a Ni-base alloy used in an actual equipment, which is in a state of aged deterioration, in order to recover a high temperature strength of the degraded component. In this case, the degraded component is subjected to the second solution heat treatment at a temperature which is higher than the solid solution temperatures of the γ' and γ" phases, and higher than the solid solution temperature of the γ phase by 10° C., and subsequently subjected to the second aging treatment at a temperature of not higher than 8000° C. to finely precipitate the γ' phase and/or the γ" phase in each crystal grain of the Ni-base alloy.

According to the present invention, it is possible to provide the Ni-base alloy having excellent high-temperature strength, and to recover a high-temperature strength of a component made of a Ni-base alloy used in an actual equipment, which is in a state of aged deterioration, in order to provide the component with a long life duration.

Other objects, features and advantages of the invention will become apparent from the following description of the embodiments of the invention taken in conjunction with the accompanying drawings.

DETAILED DESCRIPTION OF THE INVENTION

Figure 1:
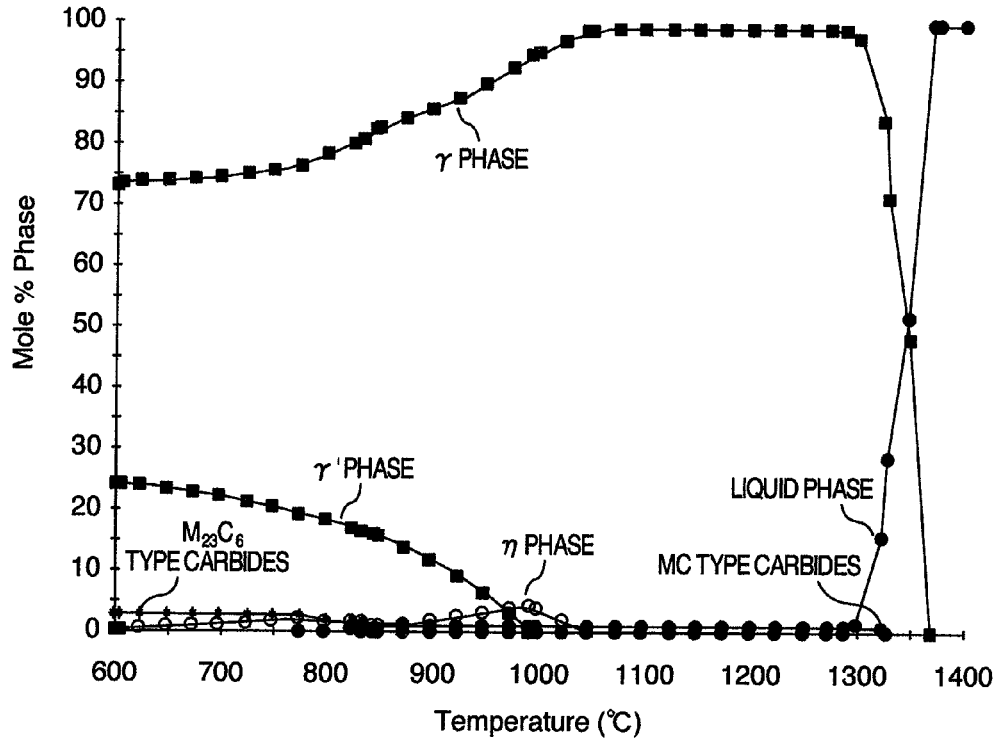
FIG. 1 is a graph showing the results of phase equilibrium calculation for the chemical components of a Specimen A.

The present inventors found that even when the Ni-base alloy is subjected to the first aging treatment at a temperature higher than 800° C. to precipitate the η phase, and subsequently to the second solution heat treatment by temperature elevation close to a temperature at which the η phase re-melt, the zigzag features of the grain boundaries are maintained.

Preferably a temperature in the second solution heat treatment is higher than the solid solution temperatures of the γ' phase and the γ" phase, and lower than the solid solution temperature of the η phase. However, even in the case where the temperature of the second solution heat treatment exceeds the solid solution temperature of the η phase whereby the η phase is lost, it is possible to maintain the zigzag features of the grain boundaries by properly controlling a time for the solution heat treatment. It was found that the temperature of the second solution heat treatment can be elevated up to a temperature higher than the solid solution temperature of the η phase by 10° C. It is noted that if a small amount of the η phase remains at the grain boundaries, since it prevents the grain boundaries from movement, the zigzag features are liable to remain. The higher the elevated temperature of the second solution heat treatment is close to the solid solution temperature of the η phase, the greater the amount of intra-grain precipitates, which are precipitated by the second aging treatment and which is effective for improving intra-grain strength, increases.

After the second solution heat treatment, the second aging treatment is carried out at a temperature of not higher than 800° C. to cause the γ' phase and/or the γ" phase to finely precipitate in each of crystal grains. Thus, it is possible to strengthen the inside of each crystal grain and to keep the zigzag features of the grain boundaries thereby ensuring the grain boundaries to have high strength. In this case, even if the η phase is not lost by the second solution heat treatment, or a small amount of the η phase precipitated by the second aging treatment remain in an alloy structure, there is no adverse affect on the alloy strength.

The invention high strength Ni-base alloy comprises not more than 0.1 wt % C, not more than 50 wt % Fe, not more than 30 wt % Cr, Ti, and at least one of Nb and Al, and is strengthened by precipitates of the γ' phase ($Ni_3Al$) and/or the γ" phase ($Ni_3Nb$). The Ni-base alloy has a characteristic that a η phase ($Ni_3Ti$), which is precipitated in the Ni-base alloy by an aging treatment, is thermodynamically stable in a temperature range of 800° C. to 900° C.

The Ni-base alloy is subjected to the following heat treatment process:

a first solution heat treatment at a temperature of not lower than solid solution temperature of a η phase ($Ni_3Ti$), a γ' phase ($Ni_3Al$), and a γ" phase ($Ni_3Nb$);

a first aging treatment by which the η phase is precipitated at a temperature of 800° C. to 900° C.;

a second solution heat treatment, at a temperature which is higher than the solid solution temperatures of the γ' and γ" phases, and higher than the solid solution temperature of the γ phase by 10° C., by which second solution heat treatment the γ' phase and the γ" phase are again dissolved;

and a second aging treatment by which at least one of the γ' phase and the γ" phase is precipitated at a temperature of not higher than 800° C., which heat treatments are carried out in the above order.

Specifically, the first solution heat treatment is carried out at a temperature (not lower than 900° C.: for example a temperature of 950° C. to 1,100° C.) higher than that (a temperature range of 800° C. to 900° C.) at which the η phase is stable. Thereafter, the γ' phase (and the γ" phase) and the η phase are precipitated by the first aging treatment (at a temperature of 800° C. to 900° C.). Further, the second solution heat treatment is carried out at a temperature higher than the solid solution temperature of the γ' phase (and γ" phase) and not higher than the solid solution temperature of the η phase, or at a temperature close to the solid solution temperature of the η phase or lower than the close temperature (i.e. not lower than 900° C.: for example a temperature of 950° C. to 1,000° C.) so as to remove the γ' phase (and the γ" phase) and the η phase while keeping the features of the grain boundaries. Thereafter, the second aging treatment is carried out to finely precipitate the γ' phase (and γ" phase) at a temperature (not lower than 800° C.: for example a temperature of 600° C. to 750° C.) at which temperature the η phase is hard to precipitate and the γ' phase (and the γ" phase) is not coarsened.

EXAMPLE 1

Table 1 shows the chemical components of a tested material (Specimen A). Table 1 does not show residual components of Ni and incidental impurities.

TABLE 1

| Fe | Cr | Ti | Nb | Al | Si | C |
|---|---|---|---|---|---|---|
| 36.1 | 16.3 | 1.7 | 2.9 | 0.4 | 0.02 | 0.03 |

FIG. 1 is a graph showing the results of phase equilibrium calculation, and indicates that with the chemical composition, the η phase precipitates at a temperature of 800° C. to 900° C. A forged material of the chemical components shown in Table 1 was produced by vacuum melting (50 kg) and hot forging, and divided into a plurality of parts. The thus obtained alloy specimens were subjected to different heat treatments from one another. Table 2 shows heat treatment conditions (1*a* to 1*c*) for three Specimens A.

TABLE 2

| Heat treatment condition | First solution heat treatment | Intermediate aging treatment | Second solution heat treatment | First aging treatment | Second aging treatment |
|---|---|---|---|---|---|
| Comparative condition 1a | 982° C., 2 h | none | none | 720° C., 8 h | 620° C., 8 h |
| Comparative condition 1b | 982° C., 2 h | 840° C., 24 h | none | 720° C., 8 h | 620° C., 8 h |
| Comparative condition 1c | 982° C., 2 h | 840° C., 24 h | 955° C., 2 h | 720° C., 8 h | 620° C., 8 h |

*Note: "h" means "hours".

Figure 2A:
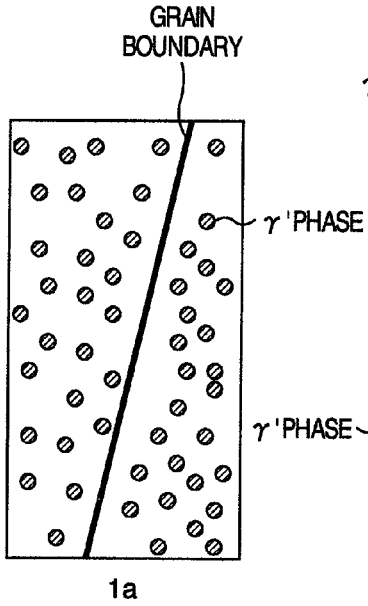
FIG. 2A is a schematic view showing a micro-structure of Specimen A subjected to a heat treatment 1*a;*
Figure 2B:
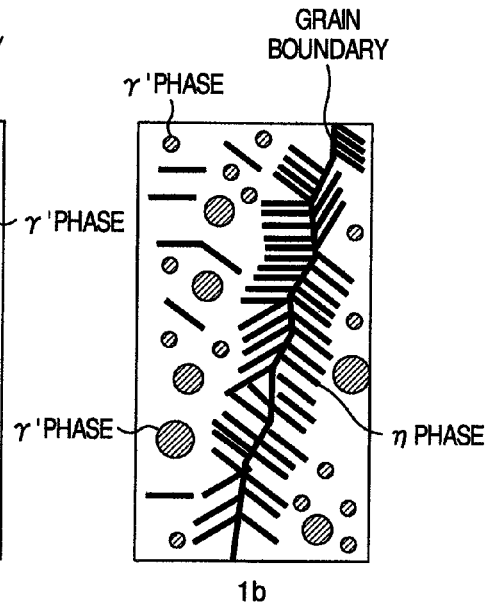
FIG. 2B is a schematic view showing a micro-structure of Specimen A subjected to a heat treatment 1*b;*
Figure 2C:
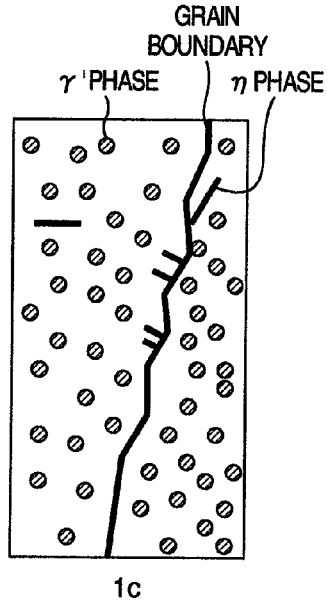
FIG. 2C is a schematic view showing a micro-structure of Specimen A subjected to a heat treatment 1*c;*
Figures 3A, 3B, 3C, 3D:
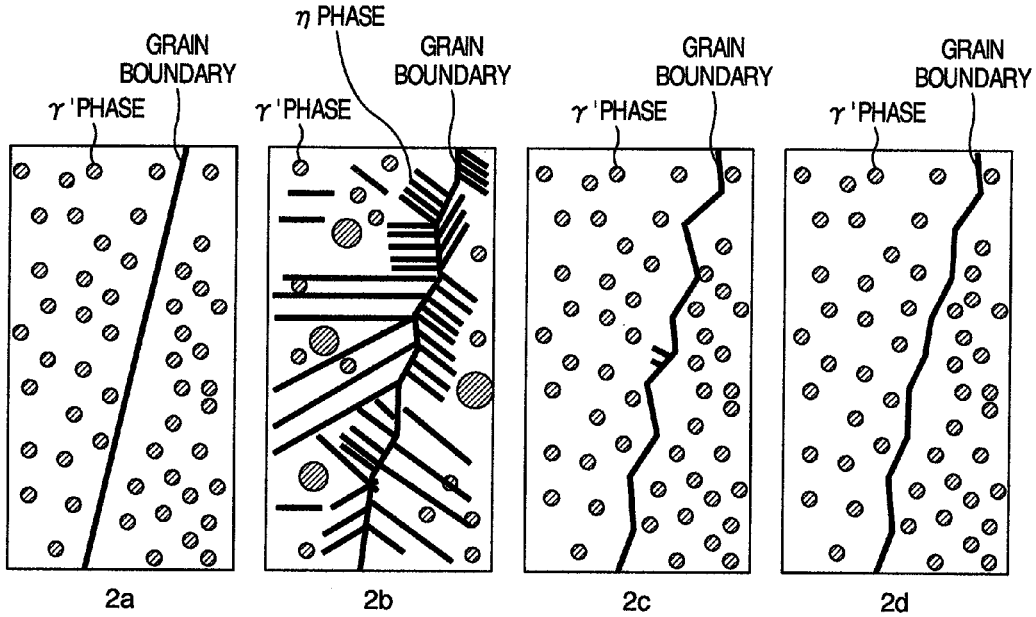
FIG. 3A is a schematic view showing a micro-structure of a Specimen B exposed to a thermal hysteresis 2*a;*
FIG. 3B is a schematic view showing a micro-structure of Specimen B exposed to a thermal hysteresis 2*b;*
FIG. 3C is a schematic view showing a micro-structure of Specimen B exposed to a thermal hysteresis 2*c;*
FIG. 3D is a schematic view showing a micro-structure of Specimen B exposed to a thermal hysteresis 2*d;*

FIGS. 2A to 2C are schematic views (i.e. cross-sectional views) of micro structures of three Specimens A subjected to three different heat treatments 1*a*, 1*b* and 1*c*, respectively. In Specimen A subjected to a heat treatment 1*a* (without intermediate aging treatment and the second solution heat treatment), fine precipitates of the γ' and γ" phases each having a particle size of about 20 nm were observed in crystal grains. However, grain boundaries were linear in a cross-sectional view. In Specimen A subjected to a heat treatment 1*b* (without the second solution heat treatment), many precipitates of the η phase were observed at some of the grain boundaries and in some of the crystal grains. The grain boundaries were zigzagged. Many precipitates of the γ' phase each of at least 100 nm were observed in the precipitate in the crystal grain. Fine γ' and γ" phases were observed between the precipitates of the γ' phases each having a particle size of at least 100 nm. In Specimen A as an invention embodiment subjected to a heat treatment 1*c*, the grain boundaries were zigzagged as is the case with the heat treatment 1*b*. However, a very small amount of the η phase precipitated at the grain boundaries. Furthermore, as is the case with the heat treatment 1*a*, fine precipitates of the γ' and γ" phases each having a particle size of about 20 nm was observed in crystal grains.

The above mentioned results indicate that the heat treatment in the present example allows Specimen A to be formed into an alloy structure in which the grain boundary is zigzagged and in which the fine precipitates are precipitated in the crystal grains. As a result, it is possible to realize precipitation strengthening of both the grain boundary and the inside of each crystal grain.

EXAMPLE 2

In the present example, a process of recovering a member comprising an Ni-base alloy applied to actual equipment will be described. Table 3 shows the chemical components of Specimen B. Besides the components shown in Table 3, Specimen B contains Ni and may contain impurities.

TABLE 3

| Mo | Cr | Ti | Co | Al | Si | C |
|---|---|---|---|---|---|---|
| 6 | 20 | 2.4 | 20 | 0.4 | 0.02 | 0.05 |

Specimen B was melted by double melting processes of vacuum melting and electro slag re-melting. The melted Specimen B was then formed into a plate having a thickness of about 5 mm by hot forging. The resultant plate material was used to produce a tubular combustor tail pipe. Before use in an actual equipment, the combustor tail pipe was subjected to heat treatments of a solution heat treatment at 1,050° C. for two hours and an aging treatment at 800° C. for 24 hours. The combustor tail pipe was used in a 1,300° C. grade gas turbine with an output power of about 25 MW for about one year. Thereafter, the combustor tail pipe was removed from the actual equipment and tested together with the plate from a part of which the combustor tail pipe was made.

Table 4 shows the thermal hysteresis of Specimens B (see 2a and 2b) observed before and after application to the actual equipment.

TABLE 4

| | First solution heat treatment | First aging treatment | Exposure conditions in an actual equipment | Second solution heat treatment | Second aging treatment |
|---|---|---|---|---|---|
| Thermal hysteresia 2a (non) | 1,050° C. 2 hours | 800° C. 24 hours | none | none | |
| Thermal hysteresia 2b (as used in an actual equipment) | | | 820° C.* 6,000 hours | none | none |
| Thermal hysteresia 2c (exposed to an invention embodiment heat treatment) | | | 820° C.* 6,000 hours | 1,000° C. 2 hours | 800° C. 24 hours |
| Thermal hysteresia 2d (exposed to an invention embodiment heat treatment) | | | 820° C.* 6,000 hours | 1,050° C. 2 hours | 800° C. 24 hours |

*Design temperature

A specimen cut off from a degraded portion of the structure was subjected to heat treatments based on thermal hysteresis 2*c* and 2*d*. A thermal hysteresis 2*a* corresponds to the unused state of the plate formed into the combustor tail pipe. A thermal hysteresis 2*b* corresponds to the as-used state of the specimen cut off from the degraded portion of the structure of the removed combustor tail pipe.

FIGS. 3A to 3D are schematic views of the structures of four Specimens B subjected to the thermal hysteresis 2*a* to 2*d*.

In the case of a Specimen B subjected to the thermal hysteresis 2*a* (corresponding to the unused state), no η phase precipitated at the grain boundaries. A large amount of the γ' phase having a particle size of about 20 nm precipitated in the crystal grains.

In the case of a Specimen B subjected to the thermal hysteresis 2*b* (corresponding to the state following the use in the actual equipment), a large amount of η phase precipitated, thus making the grain boundaries zigzag. Furthermore, the γ' phase in the crystal grains was reduced and coarsened.

In the case of a Specimen B subjected to the thermal hysteresis 2*c* (corresponding to the state following the application to the actual equipment and in which the second solution heat treatment has been carried out), the η phase in the crystal grains was lost, and fine γ' phase precipitated in the crystal grains as is the case with the thermal hysteresis 2*a*. Furthermore, the η phase was infrequently observed in the grain boundaries, which were zigzagged as is the case with the thermal hysteresis 2B.

In the case of a Specimen B subjected to the thermal hysteresis 2*d* with a higher temperature of the second solution heat treatment than the thermal hysteresis 2*c* (the thermal hysteresis 2*d* corresponds to the state following the application to the actual equipment and in which the second solution heat treatment has been carried out), a structure similar to that in the case of the thermal hysteresis 2*c* was observed. However, no η phase was observed even at the grain boundaries. The grain boundaries were zigzagged as is the case with the thermal hysteresis 2*c* but were more similar to straight lines than those resulting from the thermal hysteresis 2*c*.

Figure 4:
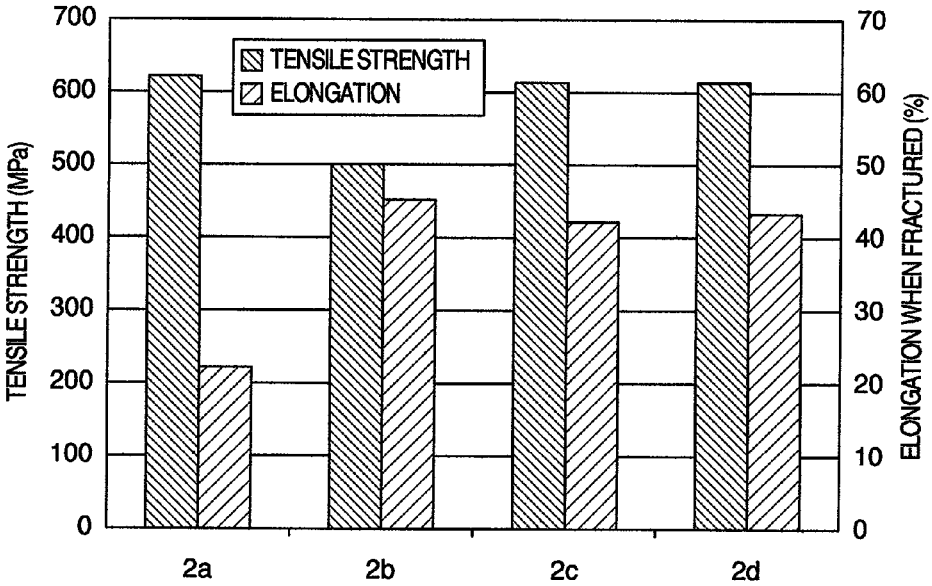
FIG. 4 is a graph showing tensile strength of Specimens B.

FIG. 4 shows the results of tensile test carried out on four Specimens B subjected to the thermal hysteresis 2*a* to 2*d*. The specimen exhibited a much lower tensile strength after the use in the actual equipment (thermal hysteresis 2*b*) than before the use in the actual equipment (thermal hysteresis 2*a*). This is due to the coarsened and reduced γ' phase for precipitation strengthening as shown in FIG. 3. Tensile elongation was larger after the use (thermal hysteresis 2*b*) than before the use (thermal hysteresis 2*a*). This is mainly due to the zigzagged grain boundaries.

When the specimen used in the actual equipment was subjected to the second solution heat treatment and aging treatment (thermal hysteresis 2*c* and 2*d*), the tensile strength recovered to almost the same value as that observed before the use (thermal hysteresis 2*a*). This is due to fine re-precipitation of the γ' phase in the crystal grains.

The tensile elongation resulting from the recovery based on the thermal hysteresis 2*c* and 2*d* was smaller than the value obtained after the use in the actual equipment (thermal hysteresis 2*b*) but was larger than the value obtained before the use in the actual equipment (thermal hysteresis 2*a*). This is because the grain boundaries were zigzagged instead of being linear. The tensile elongation was larger with the thermal hysteresis 2*c*, involving the significantly zigzagged grain boundaries, than with the thermal hysteresis 2*d*, involving the nearly linear grain boundaries.

Figure 5:
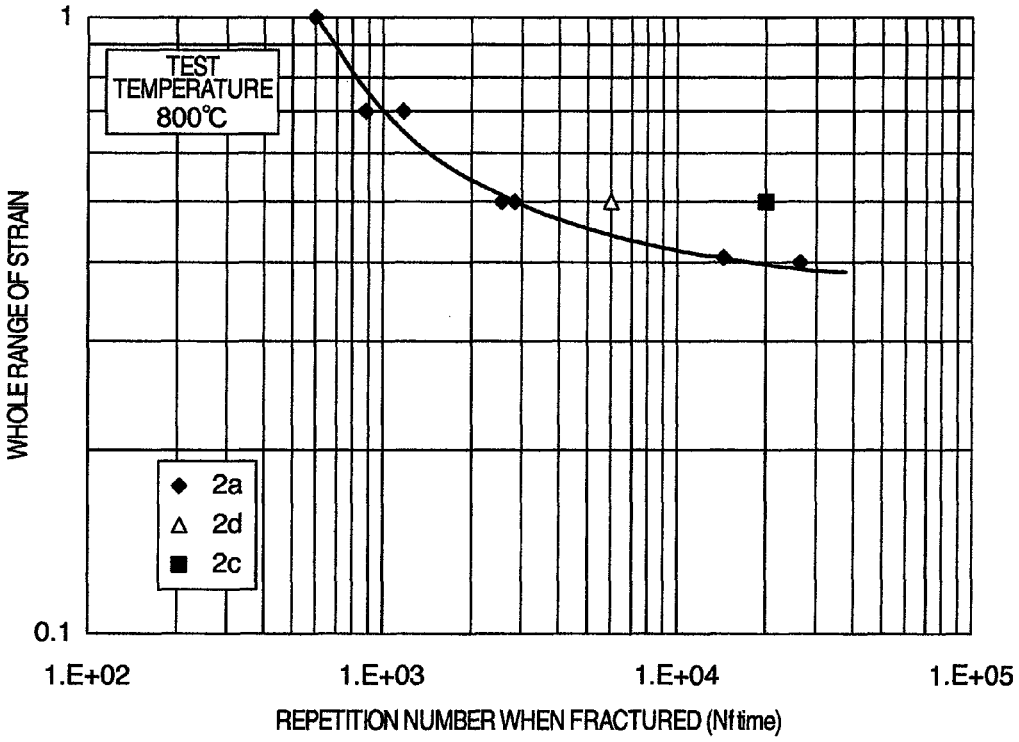
FIG. 5 is a graph showing a result of a low cycle fatigue test carried out on Specimens B.

FIG. 5 is a diagram showing the results of low cycle fatigue tests carried out on Specimen B subjected to the heat treatments based on the thermal hysteresis 2*a*, 2*c*, and 2*d*. The thermal hysteresis 2*c* resulted in significantly zigzagged grain boundaries and a fatigue life nearly tenfold longer than that obtained before the use (thermal hysteresis 2*a*).

The thermal hysteresis 2*d* also resulted in an improved fatigue life, which is shorter than that resulting from the thermal hysteresis 2*c* with the significantly zigzagged grain boundaries.

The above-described results indicate that the Ni-base alloy member with the η phase precipitated to reduce the strength as a result of the use in the actual equipment can be effectively recovered by the second solution heat treatment and the aging treatment. Furthermore, the recovered member offers a better strength characteristic and a longer lifetime than the unused member simply subjected to the solution heat treatment and the aging treatment.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A heat treatment method of an Ni-base alloy comprising:

not more than 0.1 wt % C., more than 16 wt % and not more than 50 wt % Fe, not more than 30 wt % Cr, Ti, Si, at least one of Nb and Al, and the balance being Ni and incidental impurities, the method comprising:

subjecting the Ni-base alloy to a first solution heat treatment at a temperature of not lower than solid solution temperature of a η phase ($Ni_3Ti$), a γ' phase ($Ni_3Al$), and a γ" phase ($Ni_3Nb$);

subjecting the Ni-base alloy, processed by the first solution heat treatment, to a first aging treatment to precipitate the η phase at a temperature of 800° C. to 900° C.;

subjecting the Ni-base alloy, processed by the first aging treatment, to a second solution heat treatment, at a temperature which is higher than the solid solution temperatures of the γ' and γ" phases, and higher than the solid solution temperature of the γ phase by 10° C., to cause the γ' phase and the γ" phase to again dissolve; and subjecting the Ni-base alloy, processed by the second solution heat treatment, to a second aging treatment to precipitate at least one of the γ' phase and the γ" phase at a temperature of 600-750° C.

2. The heat treatment method according to claim 1, wherein the Ni-base alloy comprises more than 10 wt % and not more than 18 wt % Cr.

3. The heat treatment method according to claim 1, wherein the temperature of the first solution heat treatment is 900-950° C.

4. The heat treatment method according to claim 1, wherein the temperature of the first aging treatment is 800-845° C.

5. The heat treatment method according to claim 1, wherein the Ni-base alloy comprises about 36.1 wt % Fe.

6. The heat treatment method according to claim 1, wherein the Ni-base alloy comprises about 16.3 wt % Cr.

7. The heat treatment method according to claim 1, wherein the temperature of the first aging treatment is about 840° C.

8. The heat treatment method according to claim 1, wherein the Ni-base alloy comprises more than 20 wt % Cr and more than 0.03 wt % C.

* * * * *